United States Patent [19]

Albus et al.

[11] 4,198,004

[45] Apr. 15, 1980

[54] JET MILL

[75] Inventors: James F. Albus, Newtown; Francis E. Albus, Hatboro, both of Pa.

[73] Assignee: Aljet Equipment Company, Willow Grove, Pa.

[21] Appl. No.: 902,925

[22] Filed: May 5, 1978

[51] Int. Cl.[2] ..... B02C 19/06

[52] U.S. Cl. ..... 241/39; 241/5

[58] Field of Search ..... 241/5, 19, 39; 55/426, 55/427; 209/211, 144

[56] References Cited

U.S. PATENT DOCUMENTS

| | | | |
|---|---|---|---|
| 1,914,282 | 6/1933 | O'Toole, Sr. | 209/144 |
| 1,978,802 | 10/1934 | Lissman | 209/144 |
| 2,237,091 | 4/1941 | Stephanoff | 241/39 X |
| 2,325,080 | 7/1943 | Stephanoff | 241/39 |
| 2,361,758 | 10/1944 | De Fligue | 209/144 |
| 2,590,220 | 3/1952 | Stephanoff | 241/39 |
| 2,643,734 | 6/1953 | Rowell | 55/427 X |
| 2,818,175 | 12/1957 | Thomas | 209/144 X |
| 2,929,501 | 3/1960 | Fenske et al. | 209/144 |
| 3,252,663 | 5/1966 | Kidwell | 241/39 |
| 3,508,714 | 4/1970 | Stephanoff | 241/39 |
| 3,614,000 | 10/1971 | Blythe | 241/5 |
| 3,648,936 | 3/1972 | Stephanoff | 241/39 |
| 3,826,065 | 7/1974 | Labbe | 209/144 X |
| 4,131,239 | 12/1978 | Stephanoff | 241/39 |

*Primary Examiner*—Mark Rosenbaum

*Attorney, Agent, or Firm*—George A. Smith, Jr.

[57] ABSTRACT

Significant improvement in the sharpness with which particles are classified by size in a recirculating jet mill is achieved by the provision of an elongated, flexible barrier strip located adjacent the outermost part of the wall of the classifier section. The positions of both ends of the strip are adjustable for controlling classification. The cross-section of the classifier section is pear-shaped, the narrow portion of the cross-section being toward the outside of the classifier section, and the barrier strip being within said narrow portion. An auxiliary outlet for large particles can be provided behind the barrier strip.

9 Claims, 7 Drawing Figures

JET MILL

SUMMARY OF THE INVENTION

This invention relates to jet mills, that is devices utilizing high velocity streams of gas for pulverization of various materials to extremely fine particle sizes. The invention is particularly concerned with jet mills of the recirculating type, and with specific improvements in such mills for effecting better particle size classification, control of particle size classification, and other improvements in their general performance.

Recirculating jet mills are widely used for effecting reduction of solid materials to extremely fine particle sizes. A typical jet mill comprises a conduit arranged to form a closed loop. The loop is usually oriented so that the flow lines within the conduit are generally in vertical planes. Typically, the loop is somewhat elongated in the vertical direction so that it comprises a curved bottom section known as a grinding chamber and a curved upper section, known as a classifier. These sections are interconnected by vertical conduit sections which are more or less straight. In the grinding chamber, gas nozzles are provided for the introduction of streams of gas (usually air or steam) at high velocities. The nozzles are directed in such a way as to produce a flow of gas in a predetermined direction around the loop. Preceding the grinding chamber in the direction of flow, a feed port is provided for feeding raw material into the gas stream circulating within the mill. The raw material is carried into the grinding chamber where it encounters the high velocity gas streams which cause the particles to collide with each other to effect pulverization. The particles are then carried upwardly by the gas stream to the classifier section at the top of the mill. There, because of the curvature of the conduit, the heavier particles are concentrated, by centrifugal force, toward the outer periphery of the classifier section. An outlet port is provided at or near the downstream end of the classifier section. The outlet port is open toward the interior of the curve of the classifier section, and fine particles are carried out through the outlet port with the gas stream. These particles are then separated from the gas stream by conventional separators such as cyclone separators, bag collectors, and the like. In the meanwhile, the heavier particles are returned to the grinding chamber, and continue to circulate in the mill until they are ground down to a sufficiently fine size to be carried out through the outlet port.

Recirculating jet mills of the type just described have been shown to be capable of better particle size classification than most other milling devices are capable of achieving. However, the particle size distribution in the product of a recirculating jet mill is always such that some large particles pass through the outlet regardless of the care taken in controlling gas flow and material feed rates. In a large measure, the inability of recirculating jet mills to achieve sharp classification between large and small particles is a result of reverse drag. That is, the stream of gas leaving the loop through the outlet port entrains a part of the gas passing through the loop at the outer periphery thereof and thereby causes some of the large particles at the outer periphery of the loop to be carried through the outlet port along with the desired fine particles.

The principal object of this invention is to improve the sharpness of particle size selection in a recirculating jet mill. It is also an object of the invention to provide simple and effective means for controlling the sharpness of particle size selection in recirculating jet mills.

These objects, and various other objects of the invention which will be apparent from the detailed description which follows, are achieved in accordance with the invention by the provision of an elongated, curved barrier, extending in the direction of flow in the mill from a location preceding the outlet port, but within the classifier section, at least to a location opposite the outlet port. This barrier is adjacent, but spaced inwardly from the outermost part of the wall of the mill, and substantially conforms to the curvature of the adjacent wall of the mill. The large particles, having been thrown to the outside wall of the mill in the part of the classifier section preceding the barrier, travel through the remainder of the classifier section on the outside of the barrier, which prevents them from being drawn toward the outlet port by reverse drag force. Consequently, the large particles are recirculated to the grinding chamber of the mill.

In order to control the degree of sharpness of particle size selection in the mill, means are provided for adjusting the radial position of the barrier, at least at its upstream end. Preferably, the barrier is a flexible, elongated strip of metal, and is provided with means at each of its ends for adjusting the radial position of each end independently.

Optimum performance of the barrier strip is achieved by providing the classification section of the mill with a pear-shaped cross-section at least from a point preceding the upstream end of the barrier strip to a point adjacent an intermediate portion of the barrier strip. The narrow portion of the pear-shaped cross-section is toward the radially outward part of the classifier section of the mill. This pear-shaped cross-section helps to concentrate the larger particles on the outward side of the barrier.

In a preferred embodiment of the invention, an auxiliary outlet passae is located adjacent the barrier strip and is open toward the exterior of the curve of the classifier section. When this auxiliary outlet is used in combination with the barrier, excess large particles, or materials which cannot be ground in the mill can be drawn off and discarded or diverted elsewhere.

DETAILED DESCRIPTION

Figure 1:
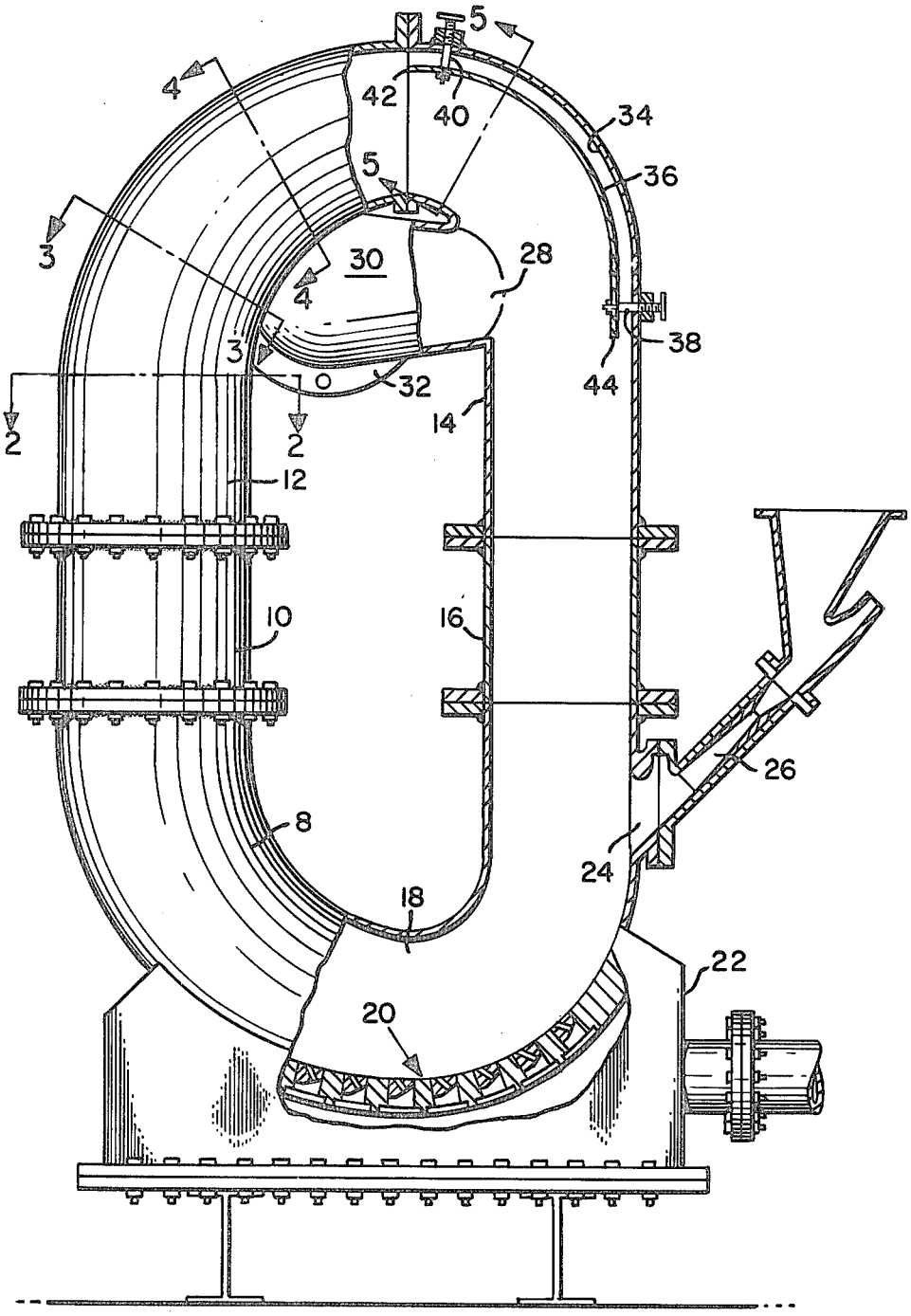
FIG. 1 is a side elevation of a recirculating jet mill in accordance with the invention, partly in section to show the location and construction of the barrier strip.
Figure 2:
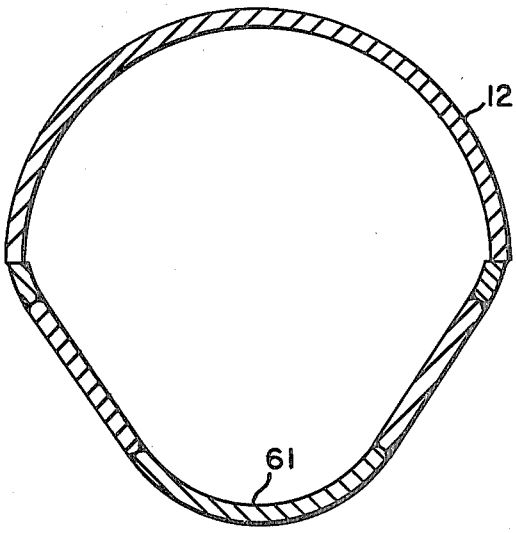
FIG. 2 is a sectional view taken on the plane 2—2 of FIG. 1.
Figure 3:
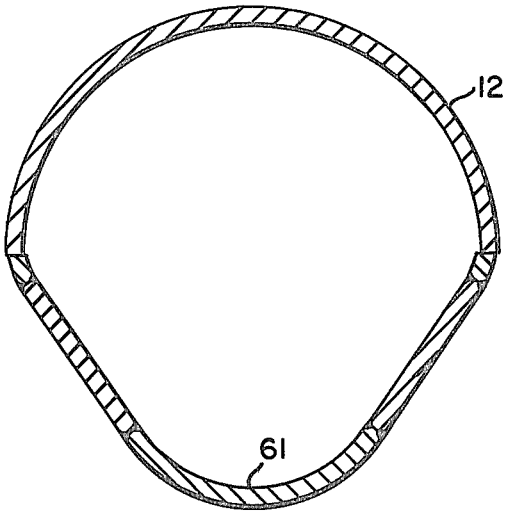
FIG. 3 is a sectional view taken on the plane 3—3 of FIG. 1.
Figure 4:
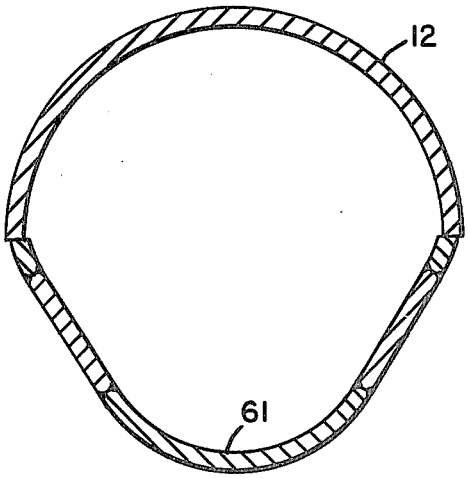
FIG. 4 is a sectional view taken on the plane 4—4 of FIG. 1.

As shown in FIG. 1, the recirculating jet mill comprises a conduit arranged to form a closed loop. While recirculating jet mills can be operated in a variety of orientations, it is customary to arrange the closed loop so that the flow lines lie in vertical planes. The conduit shown is made up of five separate conduit sections, 8, 10, 12, 14 and 16, and these sections are secured together as shown by flanges. Located within section 8 is a grinding chamber 18, having a series of gas nozzles 20, which are arranged to receive gas from a manifold 22, and to direct the gas in high velocity streams into the grinding chamber. The nozzles are arranged to produce a flow in a clockwise direction around the loop.

Solid material to be treated is introduced into section 8 through a feed port 24. The particular feed mechanism shown is a Venturi feeder, in which solid material is fed continuously through Venturi 26 into the recirculating gas stream in the loop. Various alternative feed devices are available.

Conduit section 10 is a transformer section, which provides a transition between the cross-section of the grinding chamber, which is generally trapezoidal, and the circular cross-section at the bottom of conduit section 12. Conduit section 16 likewise acts as a transformer between the circular cross-section at the bottom opening of conduit section 14 and the trapezoidal cross-section of conduit section 8 just above the feed port 24. Proceeding clockwise through sections 12 and 14, the conduit begins to curve. The curved portion within conduits 12 and 14 is known as a classifier section, and is preferably, though not necessarily, characterized by a decreasing radius of curvature, as shown. As the gas stream containing particles of various sizes proceeds in the clockwise direction through the classifier section, the larger, heavier particles tend to become concentrated against the radial outward portion of the classifier section, while the smaller, lighter particles have a lesser tendency to be concentrated toward the outside. At or near the downstream end of the classifier section, an outlet port 28 is provided. This outlet port is in communication with the interior of the conduit, and is open toward the interior of the curve of the classifier section. Since gas is fed into the loop through nozzles 20, an equivalent amount of gas escapes through outlet port 28, and the gas escaping through the outlet port carries with it the finely ground particles which are not concentrated at the outer periphery of the loop.

It will be seen that, for effective classification, outlet port 28 has to be preceded in the direction of flow by at least a portion of the curved classifier section, so that centrifugal classification can take place before the material flowing through the conduit reaches the outlet port. The outlet port is provided with a right angle bend 30 and a flange 32, through which the outlet port may communicate with cyclone separators, bag collectors or other devices for collecting the ground particles as a product. In general, recirculating loop mills are constructed substantially in the configuration depicted in FIG. 1, with the classifier constituted by an inwardly curving portion of the loop. It will be understood, however, that in any conduit arranged to form a closed loop, any uninflected curved section of the conduit can be used as a classifier. For example, the classifier could be constituted by an outwardly curved section of the conduit rather than by an inwardly curved section. In any case, the outlet port for the fine particles would be arranged on the side of the conduit which is the interior side with reference to the curvature of the classifier section.

Figure 5:
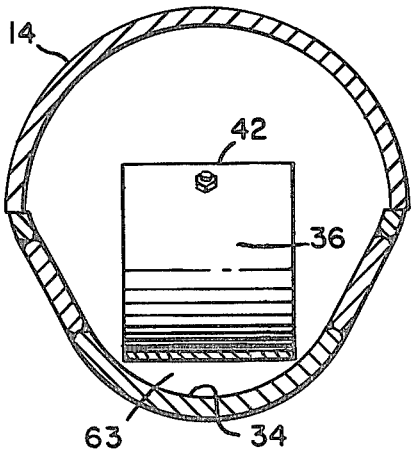
FIG. 5 is a sectional view taken on the plane 5—5 of FIG. 1.

Within the conduit, at a location adjacent but spaced inwardly, with reference to the curvature of the classifier section, from the outermost part 34 of the wall of the conduit, a barrier strip 36 is provided. The barrier strip is an elongated, curved plate having an elongated rectangular cross-section, as shown in FIG. 5. In directions lying in vertical planes, the curvature of the strip conforms substantially to the curvature of the conduit in the classifier section. Preferably, as shown in FIG. 5, the barrier strip is sufficiently wide that its long edges nearly touch the internal wall of the conduit while allowing some room for radial adjustment of the barrier. Barrier strip 36 is supported at its opposite ends by adjustable supports 38 and 40, which are provided for adjusting the radial position of the barrier strip within the conduit. The upstream end 42 of strip 36 precedes outlet port 28 in the direction of flow, but is within the curved classifier section, and is preceded by at least a portion of the classifier section, so that the larger and smaller particles are separated from each other before they reach the barrier strip. The downstream end 44 of the barrier strip extends in the direction of flow at least to a location opposite outlet port 28, though it can be made to extend well beyond the outlet port in the direction of flow. So long as it extends to a location opposite the outlet port, however, it is effective in reducing the number of large particles drawn through the outlet port by reverse drag.

Figure 6:
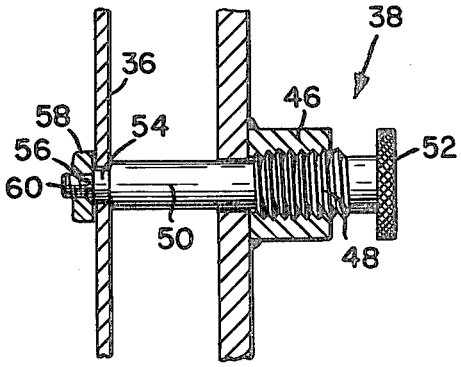
FIG. 6 is a sectional view of one of the two identical adjustment means at the opposite ends of the barrier strip.

The adjusting means are identical to each other, and adjusting means 38 is shown in detail in FIG. 6. It comprises an internally threaded boss 46 secured to the outside of the conduit. Its internal threads are engaged with threads 48 of a rod 50, having at one end a head 52, and having at its other end a reduced section 54 which extends through a hole in barrier strip 36. Section 54 is just slightly longer than the thickness of the barrier strip, and terminates in a shoulder 56, against which a nut 58 is tightened on threads 60, which extend outwardly from shoulder 56. Rod 50 is thus rotatable with respect to barrier strip 36 by manual rotation of head 52, and the action of threads 48 causes the barrier strip to move toward or away from wall 34 as desired.

Returning to FIG. 1, it will be noted that while adjusting means 38 and 40 are non-parallel, they can be adjusted nevertheless by virtue of the flexibility of strip 36. Alternatively, if strip 36 is relatively rigid, hinges or other articulations can be provided in the adjusting means in order to prevent their non-parallel relationship from interfering with their adjustment.

Adjustment of adjusting means 40 moves upstream end 42 of the barrier toward or away from wall 34, and determines the width of the aperture available for capturing large particles behind the barrier, and its adjustment affects the proportion of large particles which are present in the product carried through outlet port 28. Adjustment of adjusting means 38 is somewhat less important. However, when the upstream end 42 of the barrier is at a given distance away from the peripheral wall, the downstream end 44 should be adjusted to a similar distance away from the peripheral wall so that the barrier does not interfere with recirculating flow in the conduit or cause large particles to escape around the longitudinal edges of the barrier.

As indicated above, the lowermost ends of conduit sections 12 and 14 have circular cross-sections. In the upward direction through conduit section 12, a transition takes place from a circular cross-section to a pear-shaped cross-section. Likewise, in conduit 14, in the downward direction, a transition takes place between the pear-shaped cross-section and the circular cross-section at the bottom of conduit section 14.

The cross-section is preferably pear-shaped at least at a point preceding the upstream end 42 of the barrier strip to a point adjacent an intermediate portion of the barrier strip, and the pear-shaped cross-section preferably exists beyond the downstream end 44 of the barrier. The narrow portion of the pear-shaped cross-section is at the radially outward part of the curved section. The pear-shaped cross-sections are depicted in FIGS. 2, 3, 4 and 5. It will be noted that the cross-sectional area decreases gradually in the clockwise direction along conduit section 12, so that conduit section 12, at its upper end, conforms with the cross-section of conduit section 14, which is substantially constant. This decrease in cross-sectional area exists primarily because of design considerations resulting from the decrease in the radius of curvature in the clockwise direction along the classifier section.

Proceeding along the classifier section in the clockwise direction, the large particles tend to become more and more concentrated against the narrow end 61 of the pear-shaped cross-sections (see FIGS. 1–4), and enter the portion of the classifier having the barrier above the upstream end 42 of the barrier. These particles remain behind the barrier at least until they are opposite outlet opening 28, and are much less likely to be subject to the effects of reverse drag.

The advantage of the pear-shaped cross-section will be most readily apparent from FIG. 5, wherein it will be observed that the pocket 63, between barrier 36 and wall 34 is larger in the radial direction than would be a corresponding pocket in a circular conduit having an equivalent cross-sectional area. The use of a pear-shaped cross-section in combination with the barrier produces a highly effective discrimination between large and small particles.

While in most cases the pear-shaped cross-section with decreasing area is preferred, the barrier strip can be used to advantage in jet mills having other cross-sectional configurations in their classifier sections such as trapezoidal or other tapered configurations, in jet mills having circular cross-sections, and in jet mills having uniform cross-sections throughout.

Figure 7:
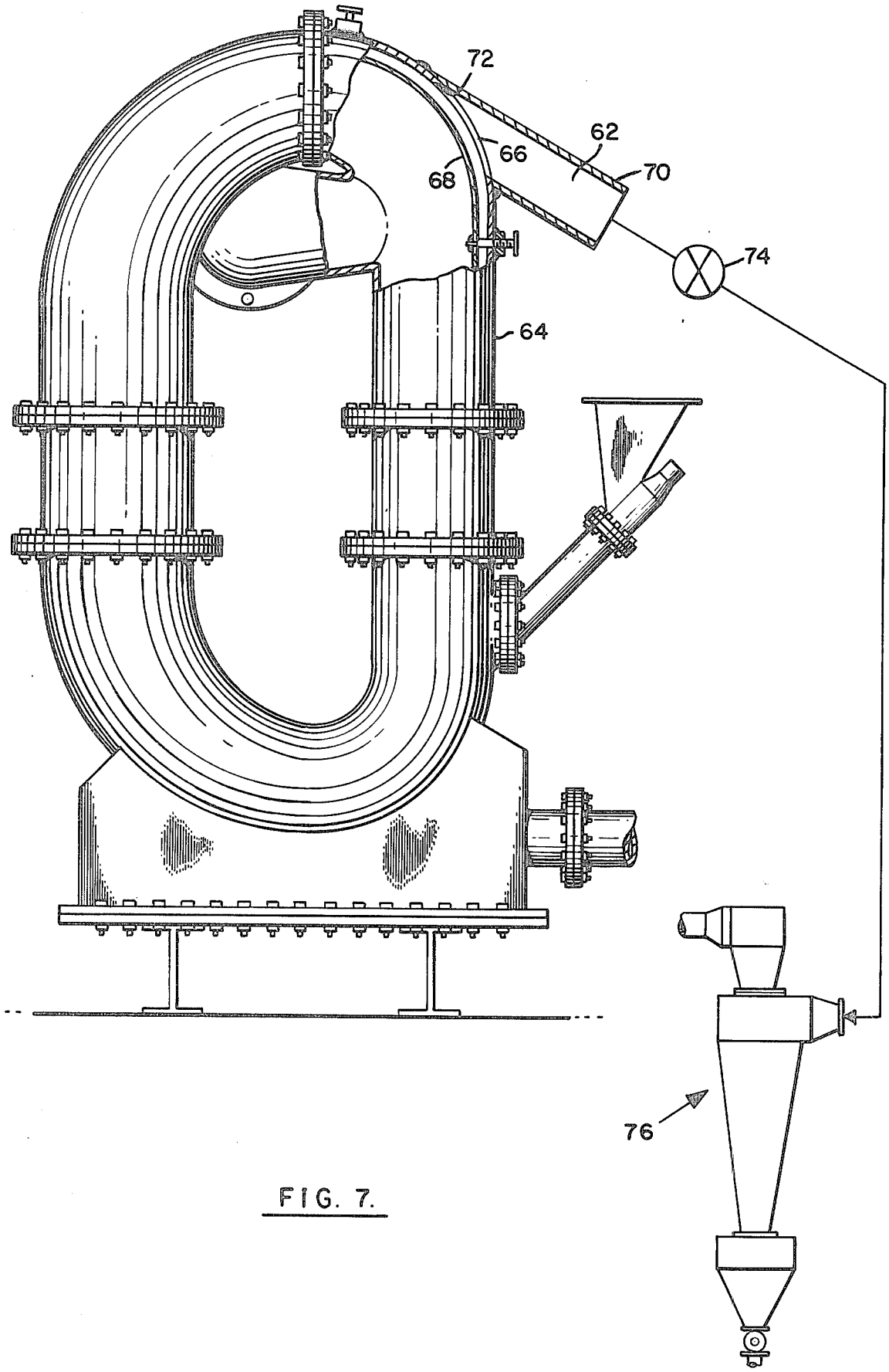
FIG. 7 is a side elevation of an alternative embodiment of the mill in accordance with the invention, partly in section to illustrate the location and construction of an auxiliary outlet passage and its relation to the barrier strip within the classifier section of the mill.

The recirculating jet mill in FIG. 7 is substantially identical to that in FIG. 1, except for the inclusion of an auxiliary outlet passage 62, which communicates with the interior of the downstack 64 of the classifier section through an opening 66, which is located behind barrier bar 68. Outlet passage 62 is formed within a cylindrical conduit 70, the axis of which is generally tangential to the direction of flow at the upper end 72 of opening 66. A valve 74 is provided to close off passage 62, or alternatively to connect passage 62 to a cyclone separator 76, or other separation device for separating particulate matter from gas.

Since opening 66 is behind barrier 68, and passage 62 is open toward the exterior of the curvator of the classifier section, large, heavy particles carried behind barrier bar 68 can be drawn off through passage 62 by opening valve 74.

Passage 62 permits materials which cannot be ground to be drawn off from the recirculating system, with a substantial saving in energy required to operate the mill. This auxiliary outlet passage is particularly useful in grinding very soft or elastic materials and abrasive products many of which are difficult to grind in a conventional jet mill.

Soft, elastic materials such as polyethylene waxes, licorice root, various toners, PTFE, and other resins are difficult to grind to extremely fine particle sizes, e.g. 100% below 325 mesh, because the particles tend to bounce off each other and resist grinding. Some of the larger particles find their way to the outlet of the conventional mill, and in the finished product there is usually a small percentage of oversized particles.

In the case of abrasive materials, as the particles are reduced in size, frequently some oversized particles find their way to the mill outlet. That is, as they are reduced in size and lose mass, the particles become unable to overcome the reverse drag force in the mill, and a small percentage of oversized particles are carried out with the finished product. In the case of metal ores there is frequently a non-uniformity of hardness in the particles being treated. Silica, for example is very hard, and resists grinding. Therefore larger particles continue to circulate in the mill and eventually find their way into the product.

Because large particles of oversize soft materials or abrasives continue to circulate in a conventional mill, their statistical chances of reaching the outlet increase with time. The barrier together with auxiliary outlet passage 62 permit these unground particles to be drawn off from the recirculating stream. This improves the quality of the product and at the same time increases the efficiency of the mill by allowing the rate of introduction of solids into the mill to be increased without increasing the air flow rate at the air inlet.

The mill of FIG. 7 can also be used in coal beneficiation, since contaminants which are substantially more difficult to grind than coal can be removed through outlet passage 62.

Various modifications can be made to the jet mill specifically described herein without departing from the scope of the invention, as defined in the following claims.

I claim:

1. In a recirculating jet mill having conduit means, nozzle means for introducing a gas into said conduit means and producing a flow of gas in a predetermined direction therein, said nozzle means being confined to a portion of said conduit means and thereby establishing said portion as a grinding chamber, means for introducing solid material into said conduit means for treatment therein, and an outlet port communicating with the interior of said conduit means said outlet port being immediately preceded in the direction of flow by a curved portion thereof and said curved portion being preceded in the direction of flow by said grinding chamber, said outlet port being open toward the interior of the curve of said curved portion, the improvement comprising barrier means within said conduit means for confining larger particles of solid material being treated to a portion of the conduit means between the barrier means and the outermost part of the wall of the conduit means as the particles approach the location of said outlet port, said barrier means being at a location adjacent and spaced inwardly from the outermost part of the wall of said conduit means, said barrier means being elongated and curved, and extending in the direction of flow from a location within said curved portion preceding the outlet port at least to a location opposite said port, the curvature of said barrier means substantially conforming, in the direction of flow in the conduit means, to the curvature of the conduit means in said curved portion thereof, said conduit means being arranged in a closed loop and providing a path for the recirculation of solid particles in said loop from both sides of said barrier means to said grinding chamber and from said grinding chamber to both sides of said barrier means.

2. A recirculating jet mill according to claim 1 having means for adjusting the radial position of said barrier means.

3. A recirculating jet mill according to claim 1 having means for adjusting the radial position of the upstream end of said barrier means.

4. A recirculating jet mill according to claim 1 wherein said barrier means comprises a flexible elongated strip and having means for adjusting the radial position of the upstream end of said strip.

5. A recirculating jet mill according to claim 1 having means at each end of said barrier means for adjusting the radial position of each end of the barrier means independently.

6. A recirculating jet mill according to claim 1 wherein said barrier means comprises a flexible elongated strip and having means at each end of said strip for adjusting the radial position of each end of the strip independently.

7. A recirculating jet mill according to claim 1 in which, at least from a point preceding the upstream end of the barrier means to a point adjacent an intermediate portion of said barrier means, the cross-section of the passage within the conduit means is tapered, the narrow portion of the tapered cross-section being at the radially outward part of said curved portion.

8. A recirculating jet mill according to claim 1 in which the cross-section of the passage within the conduit means is pear-shaped at least from a point preceding the upstream end of the barrier means to a point adjacent an intermediate portion of the barrier means, the narrow portion of the pear-shaped cross-section being at the radially outward part of said curved portion.

9. A recirculating jet mill according to claim 1 having an auxiliary outlet passage located adjacent said barrier means and being open toward the exterior of the curve of said curved portion.

* * * * *